US009586219B2

(12) United States Patent
Yamamoto et al.

(10) Patent No.: US 9,586,219 B2
(45) Date of Patent: Mar. 7, 2017

(54) COMBUSTION BURNER

(71) Applicant: TAIYO NIPPON SANSO CORPORATION, Tokyo (JP)

(72) Inventors: Yasuyuki Yamamoto, Kofu (JP); Takayuki Fujimoto, Kofu (JP); Yoshiyuki Hagihara, Kofu (JP); Kimio Iino, Tokyo (JP)

(73) Assignee: TAIYO NIPPON SANSO CORPORATION, Tokyo (JP)

( * ) Notice: Subject to any disclaimer, the term of this patent is extended or adjusted under 35 U.S.C. 154(b) by 0 days.

(21) Appl. No.: 14/772,007

(22) PCT Filed: Mar. 19, 2014

(86) PCT No.: PCT/JP2014/057495
§ 371 (c)(1),
(2) Date: Sep. 1, 2015

(87) PCT Pub. No.: WO2014/148536
PCT Pub. Date: Sep. 25, 2014

(65) Prior Publication Data

US 2016/0008830 A1 Jan. 14, 2016

(30) Foreign Application Priority Data

Mar. 21, 2013 (JP) ..... 2013-059024

(51) Int. Cl.
*B05B 7/20* (2006.01)
*F23D 14/22* (2006.01)
(Continued)

(52) U.S. Cl.
CPC ..... *B05B 7/205* (2013.01); *B05B 7/0876* (2013.01); *B05B 7/14* (2013.01); *F23C 6/047* (2013.01);
(Continued)

(58) Field of Classification Search
CPC B05B 7/20; B05B 7/201; B05B 7/205; B05B 7/0876; B05B 7/14; F23C 6/047;
(Continued)

(56) References Cited

U.S. PATENT DOCUMENTS 5,932,293 A * 8/1999 Belashchenko ..... B05B 7/1606 118/308
2011/0135775 A1 6/2011 Hagihara et al.

FOREIGN PATENT DOCUMENTS

CN 202709719 1/2013
CN 202747781 2/2013
(Continued)

OTHER PUBLICATIONS

Chinese Office Action issued in Application No. 201480003506.6 dated Mar. 31, 2016 (w/ partial translation).
International Search Report for PCT/JP2014/057495, mailed Jun. 10, 2014, 4 pages.

*Primary Examiner* — Christopher Kim
(74) *Attorney, Agent, or Firm* — Nixon & Vanderhye P.C.

(57) ABSTRACT

An object of the present invention is to provide a combustion burner which is capable of heating or melting a raw material powder efficiently by dispersing the raw material powder, and which is capable of improving a collection rate of the heated or melted raw material powder, the invention providing a combustion burner that forms flame including a dispersal member which is provided in the raw material powder outlet which spouts the raw material powder into the flame, includes first and second inclined surfaces, and which disperses the raw material powder by colliding with the raw material powder that is supplied to the raw material powder outlet.

10 Claims, 7 Drawing Sheets

(51) Int. Cl.

| | |
|---|---|
| ***F23C 6/04*** | (2006.01) |
| ***F23D 14/56*** | (2006.01) |
| ***B05B 7/08*** | (2006.01) |
| ***B05B 7/14*** | (2006.01) |

(52) U.S. Cl.
CPC ..... *F23D 14/22* (2013.01); *F23D 14/56* (2013.01); *F23C 2201/20* (2013.01); *F23C 2900/06043* (2013.01); *F23D 2900/21001* (2013.01)

(58) Field of Classification Search
CPC ..... F23C 2201/20; F23C 2900/06043; F23D 14/22; F23D 14/56; F23D 2900/21001
See application file for complete search history.

(56) References Cited

FOREIGN PATENT DOCUMENTS

| | | |
|---|---|---|
| JP | 11-325440 | 11/1999 |
| JP | 2002-139212 | 5/2002 |
| JP | 3688944 | 8/2005 |
| JP | 2006-76826 | 3/2006 |
| JP | 2008-039362 | 2/2008 |
| JP | 2009-92254 | 4/2009 |
| JP | 2009-198083 | 9/2009 |
| JP | 2010-36097 | 2/2010 |
| JP | 2010-37134 | 2/2010 |
| JP | 2010-196117 | 9/2010 |
| JP | 2012-96942 | 5/2012 |
| JP | 2012-207817 | 10/2012 |

* cited by examiner

COMBUSTION BURNER

This application is the U.S. national phase of International Application No. PCT/JP2014/057495 filed 19 Mar. 2014, which designated the U.S. and claims priority to JP Patent Application No. 2013-059024 filed 21 Mar. 2013, the entire contents of each of which are hereby incorporated by reference.

TECHNICAL FIELD

The present invention relates to a combustion burner that performs a melting process of iron, nonferrous metals, a ceramic, or glass, and a waste disposal process or the like in flame.

BACKGROUND ART

Combustion burners are used in the metal melting of iron and the like, in the manufacture of glass, in the incineration of waste, and the like. As methods that heat or melt a target object such as metal, glass, waste, or the like, using a combustion burner, there are methods that heat or melt through direct application of flame to a target object, and there are methods that heat or melt a target object indirectly using the radiant heat of flame.

In comparison with methods that heat or melt a target object indirectly using the radiant heat of flame, methods that heat or melt through direct application of flame to a target object have an advantage in that the efficiency of utilization of energy is high.

Given that, in a case in which the target object for which heating or melting is desired is a powder (a raw material powder), since the surface area per unit volume of the target object is large, it is possible to heat or melt the target object efficiently by passing the target object through the flame and/or a high temperature region in the vicinity of the flame (hereinafter, referred to as a "flame region").

Patent Documents 1 to 4 disclose combustion burners and burning methods that heat or melt by installing a powder-spouting nozzle, from which powder is spouted, in a combustion burner or in the vicinity of a combustion burner; and directly inserting the powder into the flame region while simultaneously spouting the powder.

The combustion burners that are disclosed in Patent Documents 1 and 2 have a structure that includes a raw material powder outlet which is disposed in the center of a leading end of the combustion burner, and spouts a raw material powder, a fuel outlet which is disposed in the periphery of the raw material powder outlet, and spouts fuel, and an oxygen outlet which is disposed in the periphery of the raw material powder outlet, and spouts oxygen.

The combustion burner that is disclosed in Patent Document 3 has a structure that includes a dispersal gas outlet that spouts a dispersal gas dispersing a raw material powder into the center of a leading end of the combustion burner, and a raw material powder outlet which is disposed in the vicinity of the dispersal gas outlets, and spouts the raw material powder.

The combustion burner that is disclosed in Patent Document 4 has a structure in which nozzles on a leading end surface are arranged concentrically as a whole from a central section toward an outer section in an order of a fuel supply nozzle, a primary combustion gas supply nozzle, a target process object supply nozzle, and a secondary combustion gas supply nozzle, and a leading end of the primary combustion gas supply nozzles is opened in a circular shape that surrounds a leading end opening section of the fuel supply nozzles, an oxygen enrich gas is used as a primary combustion gas and a secondary combustion gas, and only incinerator fly ash, or a mixture of incinerator fly ash and glass for basicity adjustment is used as the target object.

RELATED ART DOCUMENT

Patent Document

[Patent Document 1] Japanese Unexamined Patent Application, First Publication No. 2010-37134

[Patent Document 2] Japanese Unexamined Patent Application, First Publication No. 2010-196117

[Patent Document 3] Japanese Unexamined Patent Application, First Publication No. 2009-92254

[Patent Document 4] Japanese Patent No. 3,688,944

SUMMARY OF INVENTION

Technical Problem to be Solved

However, in cases in which the combustion burners that are disclosed in Patent Documents 1 and 2 are used, in the flame region, the dispersal of the raw material powder that is inserted into the flame from the raw material powder outlet is insufficient, and therefore, there is a problem in that a ratio of the raw material powder in which the heating or melting is insufficient is high, and heating efficiency is poor.

In a case in which the combustion burner that is disclosed in Patent Document 3 is used, if the dispersal gas is blown in at high speed in order to improve the dispersibility of the raw material powder, a flow speed of the raw material powder becomes fast, and a retention time of the raw material powder in the flame is short, and therefore, it is difficult to sufficiently heat or melt the raw material powder.

In addition, since a reduction in the temperature in a central shaft of the combustion burner is caused if a flow rate of the dispersal gas is increased using the combustion burner that is disclosed in Patent Document 3, it is difficult to efficiently heat or melt the raw material powder.

In the combustion burner that is disclosed in Patent Document 4, flame are formed in the center of the leading end of the combustion burner, and the raw material powder is spouted from the periphery of the combustion burner toward the flame. Therefore, similar to the combustion burners that are disclosed in Patent Documents 1 and 2, it is impossible to sufficiently disperse the raw material powder in the flame. Due to this, it is difficult to efficiently heat or melt the raw material powder.

In addition, in a case of using the combustion burner disclosed in Patent Document 4, since raw material powder that has not been dispersed in the flame is not recovered within the furnace, and therefore, is exhausted with combustion exhaust gas, a collection rate of the raw material powder after the process is reduced.

In such an instance, an object of the present invention is to provide a combustion burner which is capable of heating or melting a raw material powder efficiently by dispersing the raw material powder, and which is capable of improving a collection rate of the heated or melted raw material powder.

Means for Solving the Problem

The abovementioned object is achieved by (1) to (11) below.

(1) A combustion burner that forms flame including:

a raw material powder outlets which spouts a raw material powder into the flame;

a plurality of first fuel outlets, which are disposed further on an inner side than the raw material powder outlets, and which spout a first fuel;

a plurality of first oxidant outlets, which are disposed further on the inner side than the raw material powder outlets, and which spout a first oxidant;

a plurality of second fuel outlets which are disposed further on an outer side than the raw material powder outlets, and which spout a second fuel;

a plurality of second oxidant outlets which are disposed further on the outer side than the raw material powder outlets, and which spout a second oxidant; and a dispersal member which is provided in the raw material powder outlet, and which disperses the raw material powder by colliding with raw material powder that is supplied to the raw material powder outlet.

(2) The combustion burner according to (1), in which a shape of the raw material powder outlet is a ring form which is partitioned by a leading end of a first circular member and a leading end of a second circular member which is disposed on the outer side of the first circular member, and the dispersal member includes a first inclined surface that disperses the raw material powder in a direction that approaches a central axis of the combustion burner toward a leading end surface of the combustion burner, and a second inclined surface that disperses the raw material powder in a direction that becomes separated from the central axis of the combustion burner toward the leading end surface of the combustion burner.

(3) The combustion burner according to (2), in which the first inclined surface includes a plurality of inclined surfaces which are inclined at different angles in a circumferential direction of the combustion burner, and the second inclined surface includes a plurality of inclined surfaces which are inclined at different angles in a circumferential direction of the combustion burner.

(4) The combustion burner according to (2) or (3), in which the raw material powder outlet includes a first raw material powder outlet, which is partitioned by the leading end of the first circular member and the first inclined surface, and a second raw material powder outlet, which is partitioned by the leading end of the second circular member and the second inclined surface.

(5) The combustion burner according to (4) including a first raw material powder supply line which supplies the raw material powder to the first raw material powder outlet, and a second raw material powder supply line which supplies the raw material powder to the second raw material powder outlet.

(6) The combustion burner according to (2) or (3), in which the dispersal member includes a first dispersal member which has the first inclined surface, and is provided on an inner surface of the second circular member, and a second dispersal member which has the second inclined surface, is provided on an inner surface of the first circular member, and is a separate body from the first dispersal member.

(7) The combustion burner according to (6), in which the first and second inclined surfaces include a plurality of inclined surfaces which are respectively inclined at different angles.

(8) The combustion burner according to (6) or (7), in which the first and second dispersal members are disposed in a plurality in a circumferential direction of the combustion burner.

(9) The combustion burner according to any one of (2) to (8), in which an angle that is formed by the second inclined surface and a virtual plane that is parallel to the central axis of the combustion burner is within a range of greater than or equal to 5° but less than or equal to 30° when an angle that is formed by the first inclined surface and a virtual plane that is parallel to the central axis of the combustion burner is greater than or equal to 0° but less than or equal to 30°.

(10) The combustion burner according to any one of (2) to (8), in which an angle that is formed by the first inclined surface and a virtual plane that is parallel to the central axis of the combustion burner is within a range of greater than or equal to 5° but less than or equal to 30° when an angle that is formed by the second inclined surface and a virtual plane that is parallel to the central axis of the combustion burner is greater than or equal to 0° but less than or equal to 30°.

(11) The combustion burner according to any one of (1) to (10), in which the raw material powder outlet, the plurality of first fuel outlets, the plurality of first oxidant outlets, the plurality of second fuel outlets, and the plurality of second oxidant outlets are disposed concentrically with respect to the central axis of the combustion burner.

Advantageous Effects of Invention

According to the combustion burner of the present invention, since it is possible to spout dispersed raw material powder into the flame and/or a high temperature region (hereinafter, referred to as a flame region) in the vicinity of the flame by providing the raw material powder outlets with a dispersal member that disperses the raw material powder by colliding with the raw material powder that is supplied to the raw material powder outlets, it is possible to heat or melt the raw material powder efficiently in the flame region.

In addition, since spouting into the flame and/or a high temperature region in the vicinity of the flame in a state in which the raw material powder is not dispersed (an aggregated state) no longer occurs as a result of the inclusion of the dispersal member, in comparison with a case in which there is no dispersal member, it is possible to improve the collection rate of the raw material powder (the product) that is heated or melted.

BRIEF DESCRIPTION OF DRAWINGS

FIG. 2 is fixed to 0°, and an angle $\theta_2$ is changed within a range from 0 to 45.

FIG. 2 is fixed to 0°, and an angle $\theta_1$ is changed within a range from 0 to 45.

DESCRIPTION OF EMBODIMENTS

Figure 1:
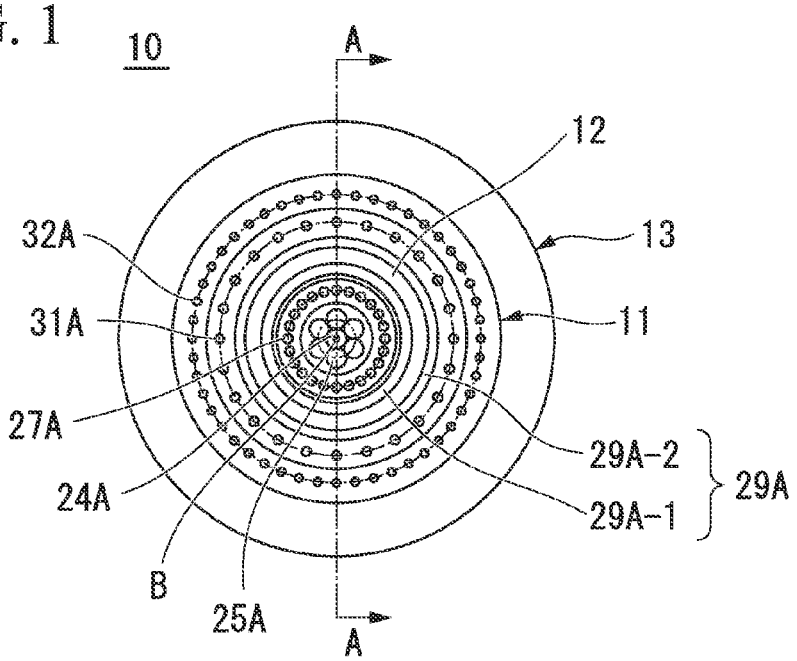
FIG. 1 is a front view of a leading end of a combustion burner according to a first embodiment of the present invention.

Hereinafter, embodiments in which the present invention has been applied will be described in detail below referring to the drawings. Additionally, the drawings that are used in the following description are for describing configurations of embodiments of the present invention, and there are cases in which the size, thickness, dimensions and the like of each section that is illustrated differ from a practical dimensional relationship of a combustion burner.

First Embodiment

Figure 2:
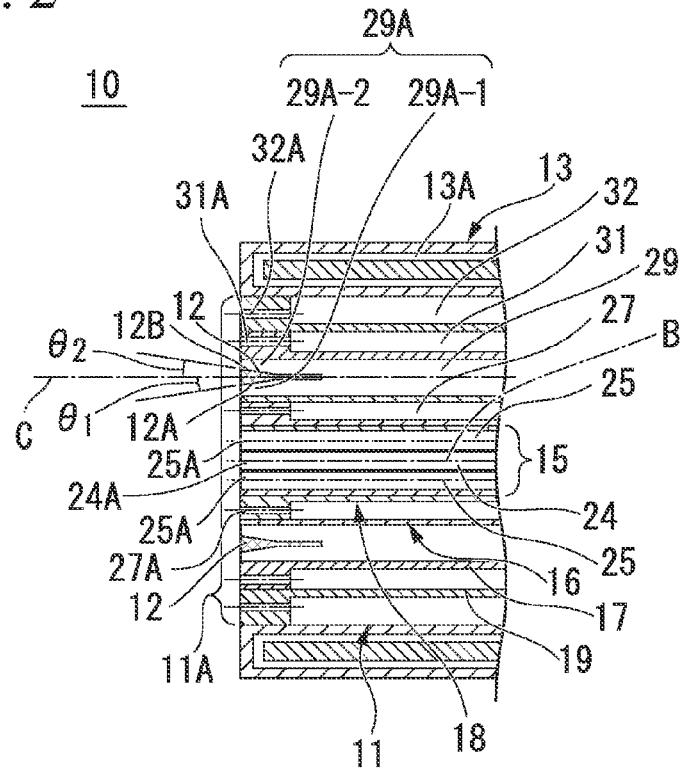
FIG. 2 is a cross-sectional view of an A-A line direction of the combustion burner that is shown in FIG. 1.

FIG. 1 is a front view of a leading end of a combustion burner according to a first embodiment of the present invention. FIG. 2 is a cross-sectional view of an A-A line direction of the combustion burner that is shown in FIG. 1. In FIG. 2, constituent portions that are the same as those of a combustion burner 10 that is shown in FIG. 1 are given the same symbols.

Referring to FIG. 1 and FIG. 2, the combustion burner 10 of the first embodiment includes a burner main body 11, a dispersal member 12, and a cooling section 13.

The burner main body 11 is provided with a leading end surface 11A on which flame is formed, and includes a first oxidant supply member 15, a first fuel supply member 18, a raw material powder supply member 16 (the first circular member), a second fuel supply member 17 (the second circular member), and a second oxidant supply member 19. As a result of this, a first fuel supply line 27, a first fuel outlet 27A, a raw material powder supply line 29, a raw material powder outlet 29A, a second fuel supply line 31, a second fuel outlet 31A, a second oxidant supply line 32, and a second oxidant outlet 32A are formed. These will be described in detail later.

The first oxidant supply member 15 is a member in which the external form is configured to have a columnar shape. The first oxidant supply member 15 includes the first oxidant supply lines 24 and 25 and the first oxidant outlets 24A and 25A.

The first oxidant supply line 24 is a tubular space, and is disposed so that a central axis thereof coincides with a central axis B of the combustion burner 10. The first oxidant supply line 25 is disposed in a plurality in ring form on an outer side of the first oxidant supply line 24. The first oxidant supply line 25 is also a tubular space.

The first oxidant supply lines 24 and 25 supply the first oxidant to the first oxidant outlets 24A and 25A. As the first oxidant, for example, it is possible to use pure oxygen.

The oxygen concentration that is included in the first oxidant can be set within a range of an air composition of 21 to 100% by volume depending on a material of the raw material powder and a heating temperature.

The first oxidant outlet 24A is disposed at a leading end of the first oxidant supply member 15, and is integral with the first oxidant supply line 24. The first oxidant outlet 25A is disposed at a leading end of the first oxidant supply member 15, and is integral with the first oxidant supply line 25.

The first oxidant outlets 24A and 25A are disposed further on an inner side than the raw material powder outlet 29A, and spout the first oxidant, which is supplied by the first oxidant supply lines 24 and 25, to a leading end surface 11A side of the burner main body 11.

The first fuel supply member 18 is a member in which the external form is configured to have a tubular shape, and is disposed on an outer side of the first oxidant supply member 15 so that a central axis thereof coincides with a central axis B of the combustion burner 10.

The raw material powder supply member 16 is a member in which the external form is configured to have a tubular shape, and is disposed on an outer side of the first fuel supply member 18 so that a central axis thereof coincides with a central axis B of the combustion burner 10.

The second fuel supply member 17 is a member in which the external form is configured to have a tubular shape, and is disposed on an outer side of the raw material powder supply member 16 so that a central axis thereof coincides with a central axis B of the combustion burner 10.

The second oxidant supply member 19 is a member in which the external form is configured to have a tubular shape, and is disposed on an outer side of the second fuel supply member 17 so that a central axis thereof coincides with a central axis B of the combustion burner 10.

The first fuel supply line 27 is a tubular space which is formed between the first fuel supply member 18 and the raw material powder supply member 16. The first fuel supply line 27 supplies the first fuel (for example, Liquefied Natural Gas (LNG)) to a plurality of first fuel outlets 27A.

The first fuel outlet 27A is disposed in a plurality at the leading end of the first fuel supply member 18. The plurality of first fuel outlets 27A are disposed further on an inner side than the raw material powder outlet 29A. The plurality of first fuel outlets 27A are integral with the first fuel supply line 27.

The plurality of first fuel outlets 27A spout the first fuel, which that has been transported by the first fuel supply line 27, to the leading end surface 11A side of the burner main body 11.

The raw material powder supply line 29 is a tubular space that is formed between the raw material powder supply member 16 and the second fuel supply member 17. The raw material powder supply line 29 supplies the raw material powder to the raw material powder outlet 29A.

It is possible to use a metal, a metal compound, a ceramic, glass, waste matter, solid fuel, a mixture of these, or the like, in which the particle diameter is less than or equal to 10 mm, as the raw material powder.

The raw material powder outlet 29A is partitioned by the leading end of the raw material powder supply member 16 (the first circular member) and the leading end of the second fuel supply member 17 (the second circular member), and is configured to be a ring form. The raw material powder outlet 29A is integral with the raw material powder supply line 29.

The raw material powder outlet 29A is divided into a first raw material powder outlet 29A-1 and a second raw material powder outlet 29A-2 by the dispersal member 12. The first and second raw material powder outlets 29A-1 and 29A-2 are integral with the raw material powder supply line 29.

The first and second raw material powder outlets 29A-1 and 29A-2 are configured to be ring forms, and are disposed on an outer side of the plurality of first fuel outlets 27A. The second raw material powder outlet 29A-2 is disposed on an outer side of the first raw material powder outlet 29A-1.

The first and second raw material powder outlets 29A-1 and 29A-2 spout the raw material powder, which is dispersed by the dispersal member 12, toward the flame that is formed at the leading end surface 11A of the burner main body 11.

The second fuel supply line 31 is a tubular space that is formed between the second fuel supply member 17 and the second oxidant supply member 19. The second fuel supply line 31 supplies the second fuel (for example, LNG) to a plurality of second fuel outlets 31A.

The second fuel outlet 31A is disposed in a plurality at the leading end of the second fuel supply member 17. The plurality of second fuel outlets 31A are provided on an outer side of the second raw material powder outlet 29A-2. The plurality of second fuel outlets 31A are integral with the second fuel supply line 31.

The plurality of second fuel outlets 31A spout the second fuel, which that has been supplied by the second fuel supply line 31, to the leading end surface 11A side of the burner main body 11.

The second oxidant supply line 32 is a tubular space that is formed between the second oxidant supply member 19 and the cooling section 13. The second oxidant supply line 32 supplies the second oxidant (for example, pure oxygen) to a plurality of second oxidant outlets 32A.

The oxygen concentration that is included in the second oxidant can be set within a range of an air composition of 21 to 100% by volume depending on a material of the raw material powder and a heating temperature.

The second oxidant outlet 32A is disposed in a plurality at the leading end of the second oxidant supply member 19. The plurality of second oxidant outlets 32A are disposed on an outer side of the plurality of second fuel outlets 31A. The plurality of second oxidant outlets 32A spout the second oxidant, which is supplied by the second oxidant supply line 32, to the leading end surface 11A side of the burner main body 11.

As described above, the first oxidant outlet 24A, the plurality of first oxidant outlets 25A, the plurality of first fuel outlets 27A, the first raw material powder outlet 29A-1, the second raw material powder outlet 29A-2, the plurality of second fuel outlets 31A, and the plurality of second oxidant outlets 32A are disposed concentrically with respect to the central axis 13 of the combustion burner 10.

The dispersal member 12 is provided in the raw material powder outlet 29A, and disperses the raw material powder by colliding with the raw material powder that is supplied to the raw material powder outlet 29A.

The dispersal member 12 is disposed so as to divide the raw material powder outlet 29A into the first raw material powder outlet 29A-1 and the second raw material powder outlet 29A-2.

The dispersal member 12 includes a first inclined surface 12A that disperses the raw material powder in a direction that approaches the central axis B of the combustion burner 10, and a second inclined surface 12B that disperses the raw material powder in a direction that becomes separated from the central axis B of the combustion burner 10.

The first inclined surface 12A opposes an outer surface of the raw material powder supply member 16 in a state of being inclined in a direction that approaches the central axis B of the combustion burner 10 toward the leading end surface 11A. The second inclined surface 12B opposes an inner surface of the second fuel supply member 17 in a state of being inclined in a direction that becomes separated from central axis B of the combustion burner 10 toward the leading end surface 11A.

When an angle $\theta_1$ that is formed by the first inclined surface 12A and the virtual plane C that is parallel to the central axis B of the combustion burner 10 is greater than or equal to 0° but less than or equal to 30°, an angle $\theta_2$ that is formed by the second inclined surface 12B and the virtual plane C that is parallel to the central axis B of the combustion burner 10 can, for example, be set within a range of greater than or equal to 5° but less than or equal to 30°.

In addition, when the angle $\theta_2$ that is formed by the second inclined surface 12B and the virtual plane C that is parallel to the central axis B of the combustion burner 10 is greater than or equal to 0° but less than or equal to 30°, an angle $\theta_1$ that is formed by the first inclined surface 12A and the virtual plane C that is parallel to the central axis B of the combustion burner 10 can, for example, be set within a range of greater than or equal to 5° but less than or equal to 30°.

In a case in which the angles $\theta_1$ and $\theta_2$ are smaller than 5°, it is not possible to disperse the raw material powder efficiently. In a case in which the angles $\theta_1$ and $\theta_2$ are larger than 30°, the collection rate of melted raw material powder is reduced.

For example, it is preferable that the angles $\theta_1$ and $\theta_2$ be set to be greater than or equal to 10° but less than or equal to 15°. By setting the angles $\theta_1$ and $\theta_2$ to be greater than or equal to 10° but less than or equal to 15°, it is possible to realize an improvement in melting efficiency of the raw material powder and an improvement in the collection rate of melted raw material powder (the product).

In this manner, since it is possible to spout dispersed raw material powder into the flame and/or a high temperature region (that is, a flame region) in the vicinity of the flame by providing the dispersal member 12, which includes the first inclined surface 12A that disperses the raw material powder in a direction that approaches the central axis B of the combustion burner 10 toward the leading end surface 11A, and the second inclined surface 12B that disperses the raw material powder in a direction that becomes separated from central axis B of the combustion burner 10 toward the leading end surface 11A, in the raw material powder outlet 29A, it is possible to heat or melt the raw material powder efficiently in the flame region.

In addition, since spouting into the flame region in a state in which the raw material powder is not dispersed (an aggregated state) no longer occurs as a result of the inclusion of the dispersal member 12, in comparison with a case in which there is no dispersal member 12, it is possible to improve the collection rate of the raw material powder (the product) that is heated or melted.

The cooling section 13 is a cylindrical member, and is disposed on an outer side of the second oxidant supply member 19. The cooling section 13 includes a cooling channel 13A through which cooling water is circulated. The cooling section 13 is a member for cooling the leading end section of the burner main body 11.

According to the combustion burner of the first embodiment, since it is possible to spout dispersed raw material powder into the flame region by providing the dispersal member 12, which includes the first inclined surface 12A that disperses the raw material powder in a direction that approaches the central axis B of the combustion burner 10 toward the leading end surface 11A, and the second inclined surface 12B that disperses the raw material powder in a direction that becomes separated from central axis B of the combustion burner 10 toward the leading end surface 11A, in the raw material powder outlet 29A, it is possible to heat or melt the raw material powder efficiently in the flame region.

In addition, since spouting into the flame region in a state in which the raw material powder is not dispersed (an aggregated state) no longer occurs as a result of the inclusion of the dispersal member 12, in comparison with a case in which there is no dispersal member 12, it is possible to improve the collection rate of the raw material powder (the product) that is heated or melted.

Second Embodiment

Figure 3:
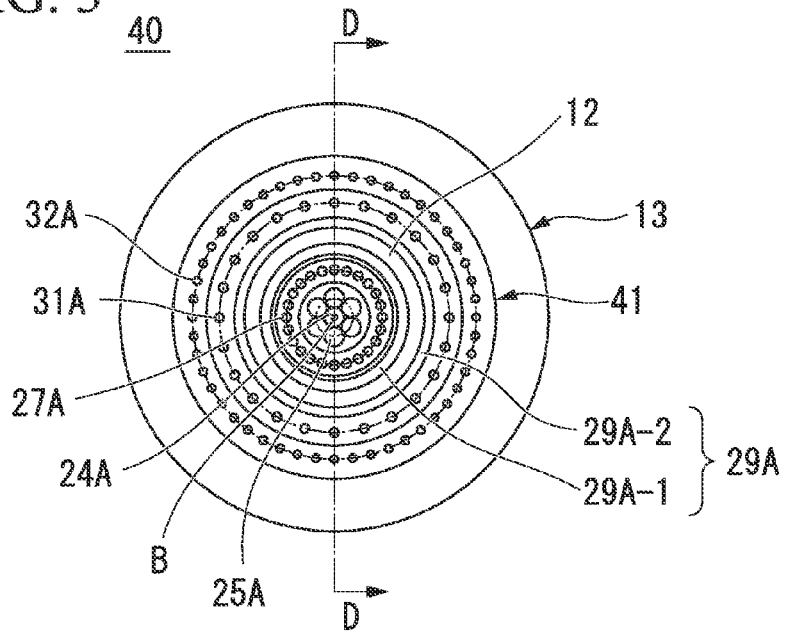
FIG. 3 is a front view of a leading end of a combustion burner according to a second embodiment of the present invention.
Figure 4:
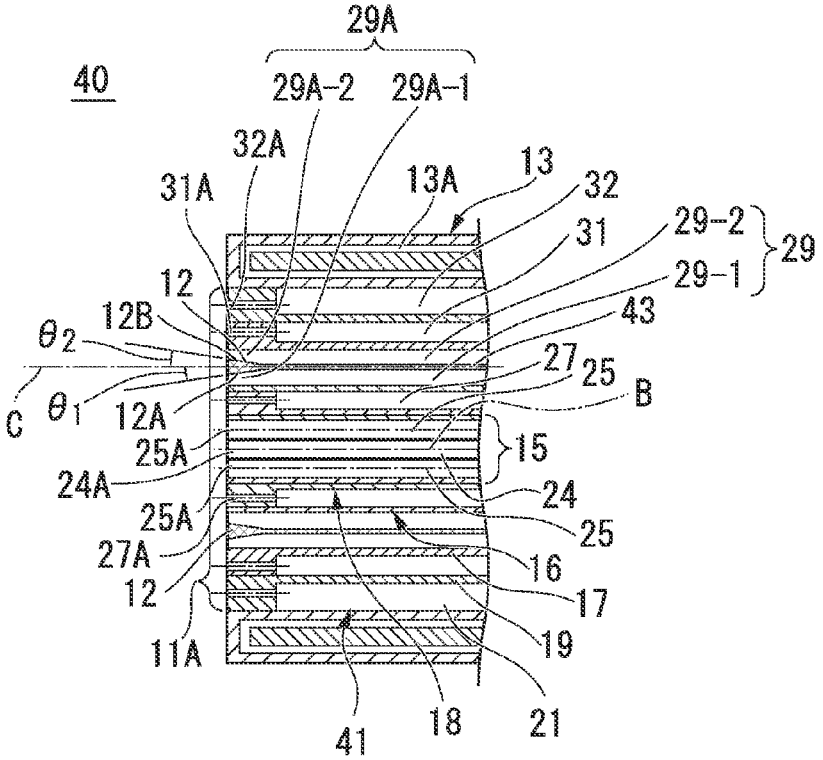
FIG. 4 is a cross-sectional view of a D-D line direction of the combustion burner that is shown in FIG. 3.

FIG. 3 is a front view of a leading end of a combustion burner according to a second embodiment of the present invention. FIG. 4 is a cross-sectional view of a D-D line direction of the combustion burner that is shown in FIG. 3. In FIG. 3 and FIG. 4, constituent portions that are the same as those of the combustion burner 10 of the first embodiment that is shown in FIG. 1 and FIG. 2 are given the same symbols.

Referring to FIG. 3 and FIG. 4, other than having a burner main body 41 in place of the burner main body 11 that configures the combustion burner 10 of the first embodiment, a combustion burner 40 of the second embodiment is configured in the same manner as the combustion burner 10.

Other than having a circular member 43 that divides the raw material powder supply line 29 into first and second raw material powder supply lines 29-1 and 29-2, the burner main body 41 is configured in the same manner as the burner main body 11 that was described in the first embodiment.

The circular member 43 is provided between the raw material powder supply member 16 and the second fuel supply member 17 in an intermediate position between the raw material powder supply member 16 and the second fuel supply member 17. An end of the circular member 43 is connected to a back end of the dispersal member 12.

The first raw material powder supply line 29-1 is a tubular space that is partitioned by the circular member 43 and the raw material powder supply member 16. The first raw material powder supply line 29-1 supplies the raw material powder to the first raw material powder outlet 29A-1.

The second raw material powder supply line 29-2 is a tubular space that is partitioned by the circular member 43 and the second fuel supply member 17. The second raw material powder supply line 29-2 supplies the raw material powder to the second raw material powder outlet 29A-2.

According to the combustion burner of the second embodiment, it is possible to obtain the same effect as the combustion burner 10 of the first embodiment by including the dispersal member 12, which is disposed in the raw material powder outlet 29A, the circular member 43 which is connected to the back end of the dispersal member 12, and divides the raw material powder supply line 29 into the first and second raw material powder supply lines 29-1 and 29-2, the first raw material powder supply line 29-1 which supplied the raw material powder to the first raw material powder outlet 29A-1, and the second raw material powder supply line 29-2 which supplies the raw material powder to the second raw material powder outlet 29A-2.

In addition, by including the first and second raw material powder supply lines 29-1 and 29-2, it is possible to supply different amounts of the raw material powder to the first and second raw material powder outlets 29-1A and 29-2A. In other words, it is possible to adjust the amount of the raw material powder that is spouted from the first and second raw material powder outlets 29-1A and 29-2A.

Third Embodiment

Figure 5:
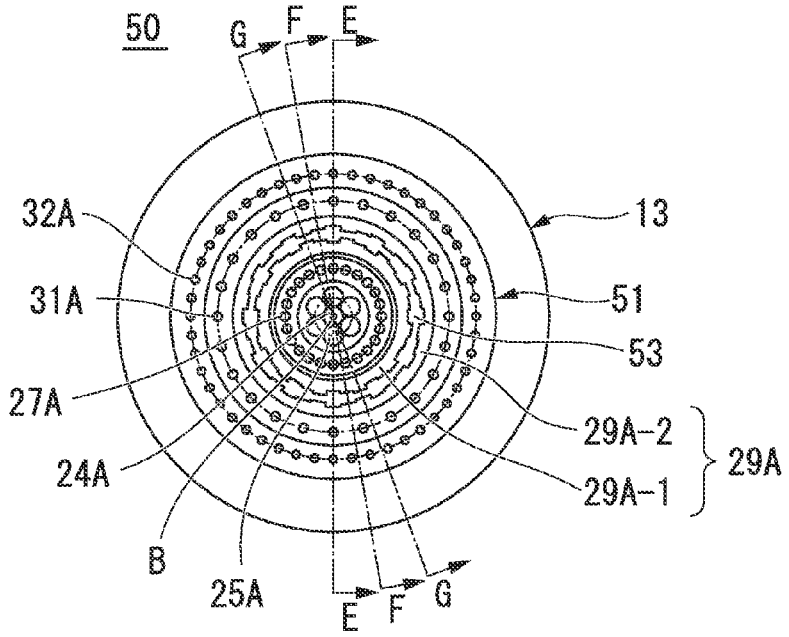
FIG. 5 is a front view of a leading end of a combustion burner according to a third embodiment of the present invention.
Figure 6:
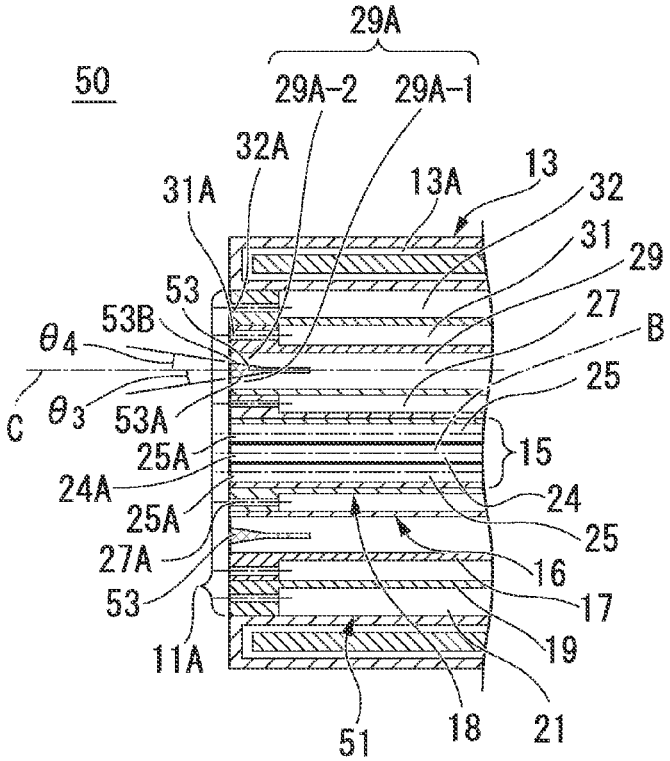
FIG. 6 is a cross-sectional view of an E-E line direction of the combustion burner that is shown in FIG. 5.
Figure 7:
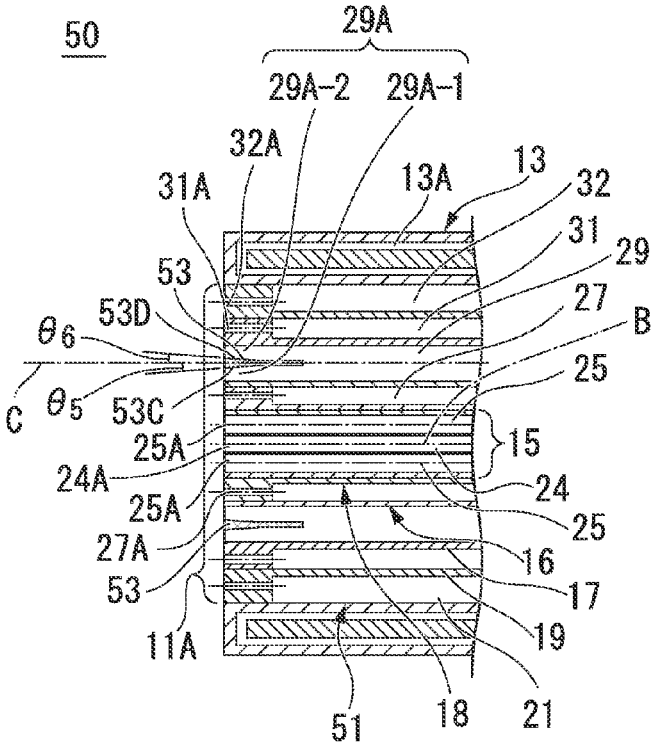
FIG. 7 is a cross-sectional view of an F-F line direction of the combustion burner that is shown in FIG. 5.
Figure 8:
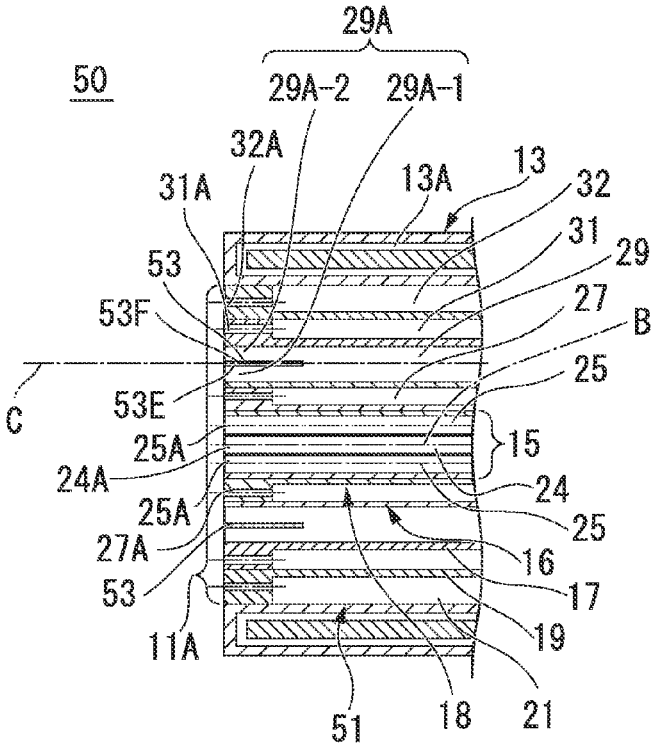
FIG. 8 is a cross-sectional view of a G-G line direction of the combustion burner that is shown in FIG. 5.

FIG. 5 is a front view of a leading end of a combustion burner according to a third embodiment of the present invention. FIG. 6 is a cross-sectional view of an E-E line direction of the combustion burner that is shown in FIG. 5. FIG. 7 is a cross-sectional view of an F-F line direction of the combustion burner that is shown in FIG. 5. FIG. 8 is a cross-sectional view of a G-G line direction of the combustion burner that is shown in FIG. 5.

In FIG. 5 to FIG. 8, constituent portions that are the same as those of the combustion burner 10 of the first embodiment that is shown in FIG. 1 and FIG. 2 are given the same symbols.

Referring to FIG. 5 to FIG. 8, other than having a burner main body 51 in place of the burner main body 11 that configures the combustion burner 10 of the first embodiment, a combustion burner 50 of the third embodiment is configured in the same manner as the combustion burner 10.

Other than having a dispersal member 53 in place of the dispersal member 12 that configures the burner main body 11 that was described in the first embodiment, the burner main body 51 is configured in the same manner as the burner main body 11.

The dispersal member 53 includes inclined surfaces 53A and 53C (a plurality of inclined surfaces), which are a plurality of first inclined surfaces, and inclined surfaces 53B and 53D (a plurality of inclined surfaces), which are a plurality of second inclined surfaces, and flat surfaces 53E and 53F.

The inclined surfaces 53A and 53C oppose an outer surface of the raw material powder supply member 16 in a state of being inclined in a direction that approaches the central axis B of the combustion burner 50 toward the leading end surface 11A. The inclined surfaces 53A and 53C are inclined at different angles with respect to a virtual plane C that is parallel to the central axis B of the combustion burner 50.

The inclined surfaces 53A and 53C are disposed in pluralities in a circumferential direction of the combustion burner 50. The inclined surfaces 53A and 53C have a function that disperses the raw material powder in a direction that approaches the central axis B of the combustion burner 50.

When an angle $\theta_4$ that is formed by the inclined surface 53B and the virtual plane C that is parallel to the central axis B of the combustion burner 50, and angle $\theta_6$ that is formed by the inclined surface 53D and the virtual plane C that is parallel to the central axis B of the combustion burner 50 are greater than or equal to 0° but less than or equal to 30°, an angle $\theta_3$ that is formed by the inclined surface 53A and the virtual plane C that is parallel to the central axis B of the combustion burner 50, and angle $\theta_5$ that is formed by the inclined surface 53C and the virtual plane C that is parallel to the central axis B of the combustion burner 50 can, for example, be set within a range of greater than or equal to 5° but less than or equal to 30°.

More specifically, it is possible to set the angles $\theta_3$ and $\theta_5$ to 20°, for example.

The inclined surfaces 53B and 53D oppose an inner surface of the second fuel supply member 17 in a state of being inclined in a direction that becomes separated from central axis B of the combustion burner 50 toward the leading end surface 11A. The inclined surfaces 53B and 53D are inclined at different angles with respect to the virtual plane C that is parallel to the central axis B of the combustion burner 50.

The inclined surfaces 53B and 53D are disposed in pluralities in a circumferential direction of the combustion burner 50. The inclined surfaces 53B and 53D have a function that disperses the raw material powder in a direction that becomes separated from the central axis B of the combustion burner 50.

When an angle $\theta_3$ that is formed by the inclined surface 53A and the virtual plane C that is parallel to the central axis B of the combustion burner 50, and angle $\theta_5$ that is formed by the inclined surface 53C and the virtual plane C that is parallel to the central axis B of the combustion burner 50 are greater than or equal to 0° but less than or equal to 30°, an angle $\theta_4$ that is formed by the inclined surface 53B and the virtual plane C that is parallel to the central axis B of the combustion burner 50, and angle $\theta_6$ that is formed by the inclined surface 53D and the virtual plane C that is parallel to the central axis B of the combustion burner 50 can, for example, be set within a range of greater than or equal to 5° but less than or equal to 30°.

More specifically, it is possible to set the angles $\theta_4$ and $\theta_6$ to 10°, for example.

The flat surfaces 53E and 53F are surfaces which are parallel to the virtual plane C, which is parallel to the central axis B of the combustion burner 50. In other words, the flat surfaces 53E and 53F are surfaces which are not inclined with respect to the virtual plane C (or in other words, surfaces in which an inclination angle with respect to the virtual plane C is 0°).

According to the combustion burner of the third embodiment, first inclined surfaces that include the plurality of inclined surfaces 53A and 53C, which are inclined at the differing angles $\theta_3$ and $\theta_5$ in the circumferential direction of the combustion burner 50, and which disperse the raw material powder at different angles in a direction that approaches the central axis B of the combustion burner 50 toward the leading end surface 11A, and second inclined surfaces that include the plurality of inclined surfaces 53B and 53D, which are inclined at the differing angles $\theta_4$ and $\theta_6$ in the circumferential direction of the combustion burner 50, and which disperse the raw material powder at different angles in a direction that becomes separated from the central axis 13 of the combustion burner 50 toward the leading end surface 11A, are included.

Therefore, since it is possible to spout more dispersed raw material powder into the flame region, it is possible to heat or melt the raw material powder more efficiently in the flame region. At the same time, it is possible to further improve the collection rate of the raw material powder (the product) that is heated or melted.

Fourth Embodiment

Figure 9:
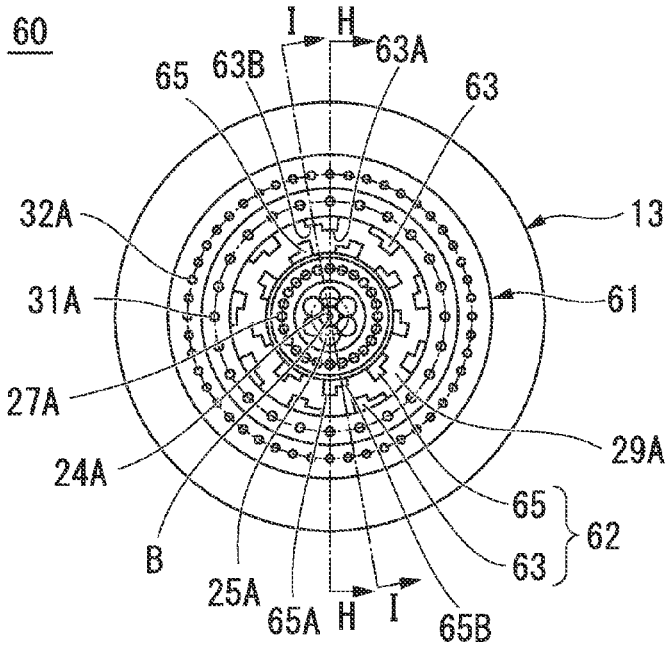
FIG. 9 is a front view of a leading end of a combustion burner according to a fourth embodiment of the present invention.
Figure 10:
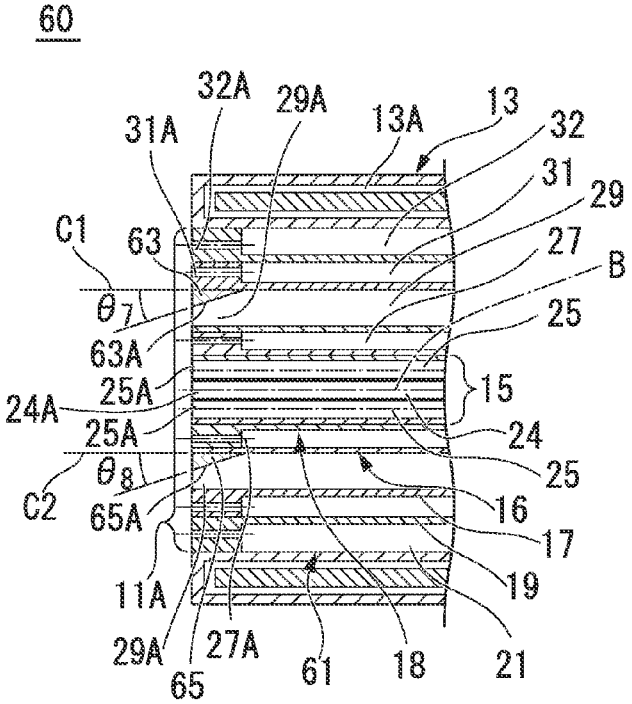
FIG. 10 is a cross-sectional view of an H-H line direction of the combustion burner that is shown in FIG. 9.
Figure 11:
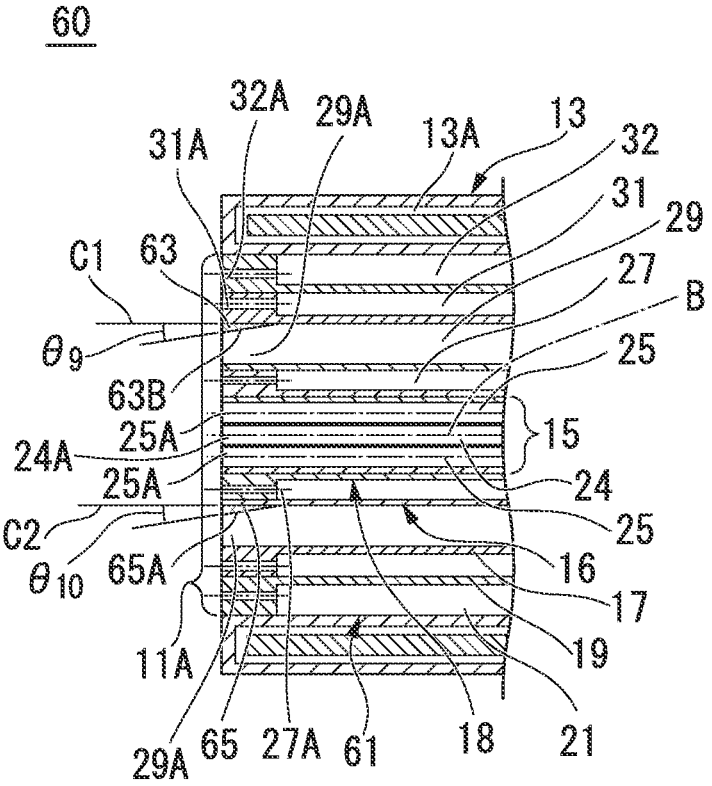
FIG. 11 is a cross-sectional view of an I-I line direction of the combustion burner that is shown in FIG. 9.

FIG. 9 is a front view of a leading end of a combustion burner according to a fourth embodiment of the present invention. FIG. 10 is a cross-sectional view of an H-H line direction of the combustion burner that is shown in FIG. 9. FIG. 11 is a cross-sectional view of an I-I line direction of the combustion burner that is shown in FIG. 9.

In FIG. 9 to FIG. 11, constituent portions that are the same as those of the combustion burner 10 of the first embodiment that is shown in FIG. 1 and FIG. 2 are given the same symbols.

Referring to FIG. 9 to FIG. 11, other than having a burner main body 61 in place of the burner main body 11 that configures the combustion burner 10 of the first embodiment, a combustion burner 60 of the fourth embodiment is configured in the same manner as the combustion burner 10.

Other than having a dispersal member 62 in place of the dispersal member 12 that configures the burner main body 11 that was described in the first embodiment, and the raw material powder outlet 29A not being divided in two by the dispersal member 62, the burner main body 61 is configured in the same manner as the burner main body 11. The dispersal member 62 is configured by pluralities of first and second dispersal members 63 and 65.

The plurality of first dispersal members 63 are disposed at predetermined intervals on the inner surface of the leading end of the second fuel supply member 17 in the circumferential direction of the combustion burner 60.

The first dispersal members 63 include inclined surfaces 63A and 63B, which are inclined at different angles. The inclined surfaces 63A and 63B oppose an inner surface of the raw material powder supply member 16 in a state of being inclined in a direction that moves toward the central axis B of the combustion burner 60 toward the leading end surface 11A.

When an angle $\theta_9$ that is formed by the inclined surface 63B and a virtual plane C1 that is parallel to the central axis B of the combustion burner 60 is greater than or equal to 0° but less than or equal to 30°, an angle $\theta_7$ that is formed by the inclined surface 63A and the virtual plane C1 that is parallel to the central axis B of the combustion burner 60 can, for example, be set within a range of greater than or equal to 5° but less than or equal to 30°.

In addition, when the angle $\theta_7$ that is formed by the inclined surface 63A and a virtual plane C1 that is parallel to the central axis B of the combustion burner 60 is greater than or equal to 0° but less than or equal to 30°, the angle $\theta_9$ that is formed by the inclined surface 63B and the virtual plane C1 that is parallel to the central axis B of the combustion burner 60 can, for example, be set within a range of greater than or equal to 5° but less than or equal to 30°.

More specifically, it is possible to set the angle $\theta_7$ to 20°, for example. In this case, the angle $\theta_9$ can, for example, be set to 10°.

In this manner, by including the first dispersal member 63, which has the inclined surfaces 63A and 63B that oppose the outer surface of the raw material powder supply member 16 in a state of being inclined at different angles in a direction that moves toward the central axis B of the combustion burner 60, it is possible to spout the raw material powder at different angles in a direction that moves toward the central axis B of the combustion burner 60.

The plurality of second dispersal members 65 are disposed at predetermined intervals on the outer surface of the leading end of the raw material powder supply member 16 in the circumferential direction of the combustion burner 60.

The second dispersal members 65 include inclined surfaces 65A and 65B, which are inclined at different angles. The inclined surfaces 65A and 65B oppose an inner surface of the second fuel supply member 17 in a state of being inclined in a direction that becomes separated from the central axis B of the combustion burner 60 toward the leading end surface 11A.

When an angle $\theta_{10}$ that is formed by the inclined surface 65B and a virtual plane C2 that is parallel to the central axis B of the combustion burner 60 is greater than or equal to 0° but less than or equal to 30°, an angle $\theta_8$ that is formed by the inclined surface 65A and the virtual plane C2 that is parallel to the central axis B of the combustion burner 60 can, for example, be set within a range of greater than or equal to 5° but less than or equal to 30°.

In addition, when the angle $\theta_8$ that is formed by the inclined surface 65A and a virtual plane C2 that is parallel to the central axis B of the combustion burner 60 is greater than or equal to 0° but less than or equal to 30°, the angle $\theta_{10}$ that is formed by the inclined surface 65B and the virtual plane C2 that is parallel to the central axis B of the combustion burner 60 can, for example, be set within a range of greater than or equal to 5° but less than or equal to 30°.

More specifically, it is possible to set the angle $\theta_8$ to 20°, for example. In this case, the angle $\theta_{10}$ can, for example, be set to 10°.

In this manner, by including the second dispersal member 65, which has the inclined surfaces 65A and 65B that oppose the inner surface of the second fuel supply member 17 in a state of being inclined at different angles in a direction that becomes separated from the central axis B of the combustion burner 60 toward the leading end surface 11A, it is possible to spout the raw material powder at different angles in a direction that becomes separated from the central axis B of the combustion burner 60.

The combustion burner 60 of the fourth embodiment which has the above-mentioned configuration can obtain the same effects as the combustion burner 50 of the third embodiment.

Preferable embodiments of the present invention have been described in detail above, but the present invention is not limited to these specific embodiments, and various modifications and alterations are possible within a range of the scope of the present invention that is disclosed in the claims.

For example, in the combustion burners 50 and 60 of the third and fourth embodiments, a case of the first and second inclined surfaces having two inclined surfaces which are respectively inclined at two different angles was described as an example, but the first and second inclined surfaces may have two or more inclined surfaces which are respectively inclined at different angles.

Experimental Example 1

In Experimental Example 1, an evaluation was performed by melting a raw material powder inside a melting furnace using three combustion burners, and measuring a melting efficiency of the raw material powder and a collection rate of melted raw material powder.

More specifically, a burner A, which was disclosed in Patent Document 1, was used in Comparative Example 1, a burner B, which was disclosed in Patent Document 4, was used in Comparative Example 2, and the combustion burner 10, which is shown in FIG. 1 and FIG. 2 was used in Example 1.

The feed rate of fuel and oxidant, and the feed rate of raw material powder that were supplied to the burner A, the burner B and the combustion burner 10 are shown in table 1. Glass particles with a particle diameter of less than or equal to 0.5 mm were used as the raw material powder. In addition, in the combustion burner 10, the angles $\theta_1$ and $\theta_2$ were set to 10°.

TABLE 1

| | | Burner A Conditions | Burner B Conditions | Combustion Burner 10 Conditions |
|---|---|---|---|---|
| Flow Rate of Fuel (LNG) [$Nm^3/h$] | Flow Rate of First Fuel (LNG) | — | — | 13.25 |
| | Flow Rate of Second Fuel (LNG) | — | — | 13.25 |
| | Total Flow Rate of Fuel (LNG) | 26.5 | 26.5 | 26.5 |
| Flow Rate of Oxygen [$Nm^3/h$] | Flow Rate of First Oxidant (Oxygen) | 10.2 | 10.2 | 24.5 |
| | Flow Rate of Second Oxidant (Oxygen) | 23.8 | 23.8 | 24.5 |
| | Flow Rate of Carrier Gas (Oxygen) | 30 | 30 | 15.0 |
| | Total Oxygen Flow Rate | 64.0 | 64.0 | 64.0 |
| Feed rate of Raw Material Powder [kg/h] | | 420 | 420 | 420 |

Table 2 shows the melting efficiency of the raw material powder and the collection rate of melted raw material powder when using the Comparative Examples 1 and 2 and the burner of the Example 1.

Additionally, the melting efficiency of the raw material powder is a value in which a heat transfer amount to the raw material powder has been divided by a fuel insertion heat amount.

The collection rate of the raw material powder is a value in which an amount of raw material powder that is melted and recovered has been divided by an insertion amount of the raw material powder.

The fuel insertion heat amount is a value in which a lower calorific value of fuel has been multiplied by a fuel flow rate. In addition, the lower calorific value of the fuel is a value in which a value, in which a water vapor amount has been multiplied by the condensation latent heat of water vapor, has been subtracted from a higher calorific value which is measured using a calorimeter, and can be calculated using the expression (1) below.

$$\text{(lower calorific value)}=\text{(higher calorific value)}-\text{(condensation latent heat of water vapor)}\times\text{(water vapor amount)} \quad (1)$$

TABLE 2

| | Comparative Example 1 | Comparative Example 2 | Example 1 |
|---|---|---|---|
| Melting efficiency of Raw Material Powder (%) | 53 | 58 | 67 |
| Collection Rate of Melted Raw Material Powder (%) | 96.2 | 97.3 | 99.5 |

Referring to Table 2, in comparison with Comparative Examples 1 and 2, favorable results were obtained in both melting efficiency and collection rate in Example 1. As a result of this, it was possible to confirm that the combustion burner 10 of Example 1 has an effect of improving on the melting efficiency and the collection rate of the burners A and B of the related art,

Experimental Example 2

In Experimental Example 2, an evaluation was performed by measuring a melting efficiency of the raw material powder and a collection rate of melted raw material powder in cases in which the angles $\theta_1$ and $\theta_2$ of the combustion burner 10 that is shown in FIG. 1 and FIG. 2, were changed.

More specifically, a melting efficiency of the raw material powder and a collection rate of melted raw material powder were measured in cases in which the angle $\theta_1$ was fixed to 0°, and the angle $\theta_2$ was changed in a range of 0 to 45°. The results of the evaluation are shown in FIG. 12.

In addition, a melting efficiency of the raw material powder and a collection rate of melted raw material powder were measured in cases in which the angle $\theta_2$ was fixed to 0°, and the angle $\theta_1$ was changed in a range of 0 to 45°. The results of the evaluation are shown in FIG. 13.

Additionally, other than the angles $\theta_1$ and $\theta_2$ of the combustion burner 10, the conditions were the same as the conditions of experimental example 1.

Figure 12:
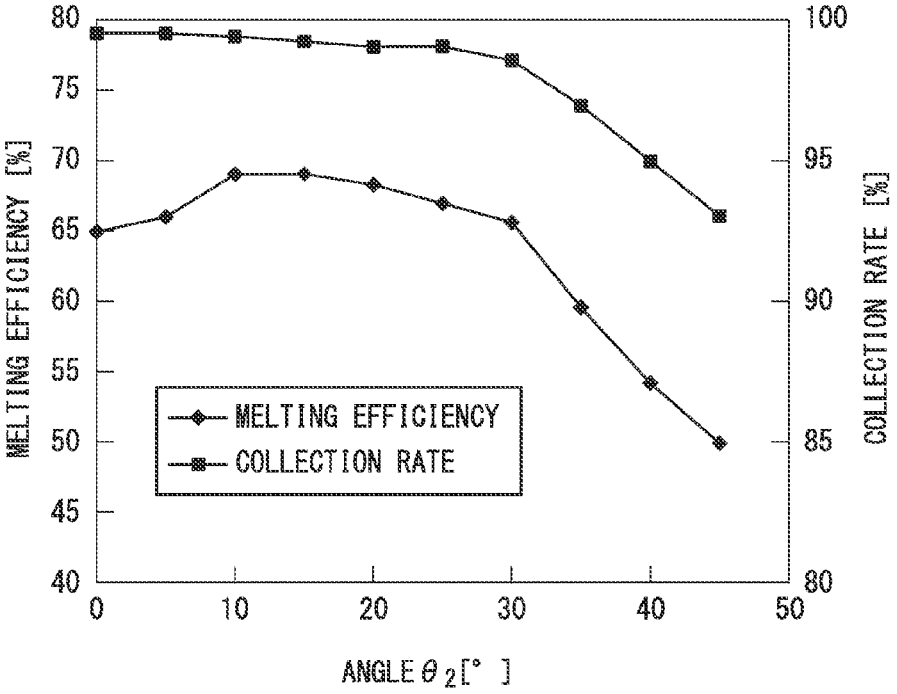
FIG. 12 is a view that shows results of melting efficiency of the raw material powder and melted raw material powder collection rate in cases in which an angle $\theta_1$ of the combustion burner that is shown in FIG. 1
Figure 13:
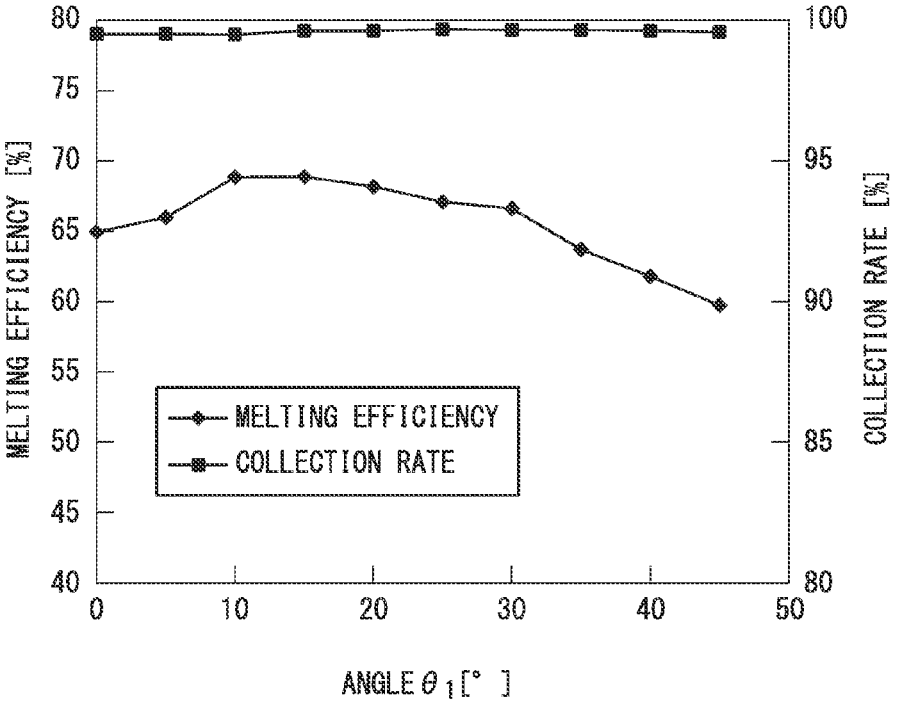
FIG. 13 is a view that shows results of melting efficiency of the raw material powder and melted raw material powder collection rate in cases in which an angle $\theta_2$ of the combustion burner that is shown in FIG. 1

As shown in FIG. 12 and FIG. 13, in the case in which the angle $\theta_1$ was fixed to 0°, it was possible to confirm that the melting efficiency of the raw material powder and the collection rate of melted raw material powder were preferable when the angle $\theta_2$ is within a range of greater than or equal to 5° but less than or equal to 30°.

In addition, in the case in which the angle $\theta_2$ was fixed to 0°, it was possible to confirm that the melting efficiency of the raw material powder and the collection rate of melted raw material powder were preferable when the angle $\theta_1$ is within a range of greater than or equal to 5° but less than or equal to 30°.

In particular, it was possible to confirm that the angles $\theta_1$ and $\theta_2$ within a range of greater than or equal to 10° but less than or equal to 15° is favorable.

Additionally, in the same manner as the case in which the $\theta_1$ was fixed to 0°, it was also possible to obtain favorable results when the angle $\theta_2$ was within a range of greater than or equal to 5° but less than or equal to 30° in a case in which the $\theta_1$ was fixed to 30°, and the $\theta_2$ was changed within a range of 0 to 45°.

In addition, in the same manner as the case in which the $\theta_2$ was fixed to 0°, it was also possible to obtain favorable results when the angle $\theta_1$ was within a range of greater than or equal to 5° but less than or equal to 30° in a case in which the $\theta_2$ was fixed to 30°, and the $\theta_1$ was changed within a range of 0 to 45°.

Experimental Example 3

In Experimental Example 3, an evaluation was performed by melting the raw material powder (glass particles in which the particle diameter is less than or equal to 0.5 mm) in a melting furnace using the combustion burner 50 of the third embodiment, which is shown in FIG. 5 to FIG. 8, as Example 2, and measuring a melting efficiency of the raw material powder and a collection rate of melted raw material powder.

In this instance, in the combustion burner 50, the angles $\theta_3$ and $\theta_4$ were set to 20°, the angles $\theta_5$ and $\theta_6$ were set to 10°, and angles that are formed by the flat surfaces 53E and 53F and the virtual plane C were set to 0°.

Apart from this, other conditions of the combustion burner 50 (more specifically, the first and second fuel gases, the first and second oxidants, the carrier gas, and the like) used the same conditions as Example 1, which was described in Experimental Example 1.

Favorable results in which the melting efficiency of the raw material powder was 68.5%, and the collection rate of melted raw material powder was 99.5%, were obtained.

Experimental Example 4

In Experimental Example 4, an evaluation was performed by melting the raw material powder (glass particles in which the particle diameter is less than or equal to 0.5 mm) in a melting furnace using the combustion burner 60 of the fourth embodiment, which is shown in FIG. 9 to FIG. 11, as Example 3, and measuring a melting efficiency of the raw material powder and a collection rate of melted raw material powder.

In this instance, in the combustion burner 60, the angles $\theta_7$ and $\theta_8$ were set to 20°, and the angles $\theta_9$ and $\theta_{10}$ were set to 10°. Apart from this, other conditions of the combustion burner 60 (more specifically, the first and second fuel gases, the first and second oxidants, the carrier gas, and the like) used the same conditions as Example 1, which was described in Experimental Example 1.

Favorable results in which the melting efficiency of the raw material powder was 67.3%, and the collection rate of melted raw material powder was 99.6%, were obtained.

INDUSTRIAL APPLICABILITY

The present invention can be applied to a combustion burner that performs a melting process of iron, nonferrous metals, a ceramic, or glass, a waste disposal process or the like in flame.

REFERENCE SIGNS LIST

10, 40, 50, 60 combustion burner
11, 41, 51, 61 burner main body
11A leading end surface
12, 53, 62 dispersal member
12A first inclined surface
12B second inclined surface
13 cooling section
13A cooling channel
15 first oxidant supply member
16 raw material powder supply member
17 second fuel supply member
18 first fuel supply member
19 second oxidant supply member
24, 25 first oxidant supply line
24A, 25A first oxidant outlet
27 first fuel supply line
27A first fuel outlet
29 raw material powder supply line
29A raw material powder outlet
29A-1 first raw material powder outlet
29A-2 second raw material powder outlet
29-1 first raw material powder supply line
29-2 second raw material powder supply line
31 second fuel supply line
31A second fuel outlet
32 second oxidant supply line
32A second oxidant outlet
43 circular member
53A, 53B, 53C, 53D, 63A, 63B, 65A, 65B inclined surface
53E, 53F flat surface
63 first dispersal member
65 second dispersal member
B central axis
C, C1, C2 virtual plane
$\theta_1$ to $\theta_{10}$ angle

The invention claimed is:

1. A combustion burner that forms flame comprising:

a raw material powder outlets which spouts a raw material powder into the flame;

a plurality of first fuel outlets, which are disposed further on an inner side than the raw material powder outlets, and which spout a first fuel;

a plurality of first oxidant outlets, which are disposed further on the inner side than the raw material powder outlets, and which spout a first oxidant;

a plurality of second fuel outlets which are disposed further on an outer side than the raw material powder outlets, and which spout a second fuel;

a plurality of second oxidant outlets which are disposed further on the outer side than the raw material powder outlets, and which spout a second oxidant; and a dispersal member which is provided in the raw material powder outlet, and which disperses the raw material powder by colliding with raw material powder that is supplied to the raw material powder outlet, wherein a shape of the raw material powder outlet is a ring form which is partitioned by a leading end of a first circular member and a leading end of a second circular member which is disposed on the outer side of the first circular member, and the dispersal member includes a first inclined surface that disperses the raw material powder in a direction that approaches a central axis of the combustion burner toward a leading end surface of the combustion burner, and a second inclined surface that disperses the raw material powder in a direction that becomes separated from the central axis of the combustion burner toward the leading end surface of the combustion burner.

2. The combustion burner according to claim 1, wherein the first inclined surface includes a plurality of inclined surfaces which are inclined at different angles in a circumferential direction of the combustion burner, and wherein the second inclined surface includes a plurality of inclined surfaces which are inclined at different angles in a circumferential direction of the combustion burner.

3. The combustion burner according to claim 1, wherein the raw material powder outlet includes a first raw material powder outlet, which is partitioned by the leading end of the first circular member and the first inclined surface, and a second raw material powder outlet, which is partitioned by the leading end of the second circular member and the second inclined surface.

4. The combustion burner according to claim 3, wherein the combustion burner comprises a first raw material powder supply line which supplies the raw material powder to the first raw material powder outlet, and a second raw material powder supply line which supplies the raw material powder to the second raw material powder outlet.

5. The combustion burner according to claim 1, wherein the dispersal member includes a first dispersal member which has the first inclined surface, and is provided on an inner surface of the second circular member, and a second dispersal member which has the second inclined surface, is provided on an inner surface of the first circular member, and is a separate body from the first dispersal member.

6. The combustion burner according to claim 5, wherein the first and second inclined surfaces include a plurality of inclined surfaces which are respectively inclined at different angles.

7. The combustion burner according to claim 5, wherein the first and second dispersal members are disposed in a plurality in a circumferential direction of the combustion burner.

8. The combustion burner according to claim 1, wherein an angle that is formed by the second inclined surface and a virtual plane that is parallel to the central axis of the combustion burner is within a range of greater than or equal to 5° but less than or equal to 30° when an angle that is formed by the first inclined surface and a virtual plane that is parallel to the central axis of the combustion burner is greater than or equal to 0° but less than or equal to 30°.

9. The combustion burner according to claim 1, wherein an angle that is formed by the first inclined surface and a virtual plane that is parallel to the central axis of the combustion burner is within a range of greater than or equal to 5° but less than or equal to 30° when an angle that is formed by the second inclined surface and a virtual plane that is parallel to the central axis of the combustion burner is greater than or equal to 0° but less than or equal to 30°.

10. The combustion burner according to claim 1, wherein the raw material powder outlet, the plurality of first fuel outlets, the plurality of first oxidant outlets, the plurality of second fuel outlets, and the plurality of second oxidant outlets are disposed concentrically with respect to the central axis of the combustion burner.

* * * * *